US009239216B2

(12) United States Patent
Hartcraft

(10) Patent No.: US 9,239,216 B2
(45) Date of Patent: Jan. 19, 2016

(54) ARROWHEAD

(71) Applicant: Barnett Outdoors, LLC, Tarpon Springs, FL (US)

(72) Inventor: Terry W. Hartcraft, Fredericksburg, TX (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 14/482,016

(22) Filed: Sep. 10, 2014

(65) Prior Publication Data

US 2015/0168110 A1 Jun. 18, 2015

Related U.S. Application Data

(60) Provisional application No. 61/916,013, filed on Dec. 13, 2013.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 4,529,208 | A * | 7/1985 | Simo | 473/584 |
| 5,871,410 | A * | 2/1999 | Simo et al. | 473/583 |
| 7,011,589 | B2 | 3/2006 | Davis | |
| 8,382,617 | B2 * | 2/2013 | Davis | 473/584 |

OTHER PUBLICATIONS http://www.basspro.com/G5-Outdoors-Striker-FixedBlade-Broadheads/product/79647/.

* cited by examiner

*Primary Examiner* — John Ricci
(74) *Attorney, Agent, or Firm* — Jones Walker LLP

(57) ABSTRACT

An arrowhead having a tip end, a shaft end, and a longitudinal axis intersecting the tip end and the shaft end. The arrowhead has a first portion longitudinally positioned between the tip end and the shaft end and having a first maximum diameter. The first portion is divided into a plurality of sections spaced circumferentially apart to define longitudinal grooves. Each section comprises a first planar surface, a second planar surface not parallel to the first planar surface, a concave surface adjacent to the first planar surface, the second planar surface, the rear end portion, and the front intermediate section. A longitudinally-convex surface is adjacent to the concave surface.

10 Claims, 4 Drawing Sheets

ARROWHEAD

CROSS-REFERENCES TO RELATED APPLICATIONS

This original nonprovisional application claims benefit of and priority to U.S. provisional application Ser. No. 61/916,013, filed Dec. 13, 2013, which is incorporated by reference.

STATEMENT REGARDING FEDERALLY SPONSORED RESEARCH

Not applicable.

BACKGROUND OF THE INVENTION

1. Field of the Invention

The present invention relates to archery equipment for use in hunting game. More specifically, the present invention relates to an improved arrowhead and an arrow incorporating such arrowhead.

2. Description of the Related Art

Bow hunters use bows and arrows to shoot at game. Contemporary bows are of a compound design to increase the force applied to the arrow. In addition, contemporary bows and arrows incorporate various elements to increase the accuracy of the shot.

The primary accuracy-affecting element of an arrow is the fletching, but the shape of the arrowhead can also affect stability of the missile. During flight, pressure on arrowhead surfaces presented to the flight direction is increased relative to the same arrow at rest. Generally, the larger the aerodynamic profile presented in the flight direction, the greater the drag forces exerted on the arrowhead.

Arrowhead design also affects the lethality of the missile when it strikes the target. Generally, the larger the arrowhead, the more damage is inflicted upon impact. In addition, many modern arrowheads are designed to have "blood" grooves, which are longitudinal grooves that facilitate bleeding by inhibiting blockage of the wound by the arrowhead and attached shaft.

One model of modern arrowhead incorporating a blood groove is the Striker™ broadhead manufactured by G5 Outdoors LLC of Memphis, Mo. The Striker™ includes blood grooves formed by a convex surface circumferentially positioned between replaceable blades.

FIGS. 1-3 show a prior art arrowhead 20 attached to a shaft 22 with blood grooves 24 extending longitudinally between a tip portion 26 and an enlarged intermediate portion 28. A rear portion 30 is threaded to the shaft 22. The intermediate portion 28 has a number of blade-receiving grooves 32 circumferentially spaced around a longitudinal axis 34 extending between the tip portion 28 and the rear portion 30. The grooves 32 are defined by pairs of circumferentially adjacent and identical sections 36, each comprising longitudinally concave surfaces 38. The largest diameter of the intermediate portion 28 is equal to the diameter of the shaft 22. The intermediate portion 28 does not include any longitudinally-convex surfaces, and the profile of the longitudinally concave surfaces 38 along the axis 34 is continuously curved.

BRIEF SUMMARY OF THE INVENTION

The present invention is an arrowhead that provides improved stability during flight while optimizing the damage imposed on a game. The invention further facilitates quicker bleeding by the game, which results in quicker formation of a blood trail for tracking An arrowhead having a tip end, a shaft end, and a longitudinal axis intersecting the tip end and the shaft end. The arrowhead has a first portion longitudinally positioned between the tip end and the shaft end and having a first maximum diameter. The first portion is divided into a plurality of sections spaced circumferentially apart to define longitudinal grooves. Each section comprises a first planar surface, a second planar surface not parallel to the first planar surface, a concave surface adjacent to the first planar surface, the second planar surface, the rear end portion, and the front intermediate section. A longitudinally-convex surface is adjacent to the concave surface.

DETAILED DESCRIPTION OF THE VARIOUS EMBODIMENTS

Figure 1:
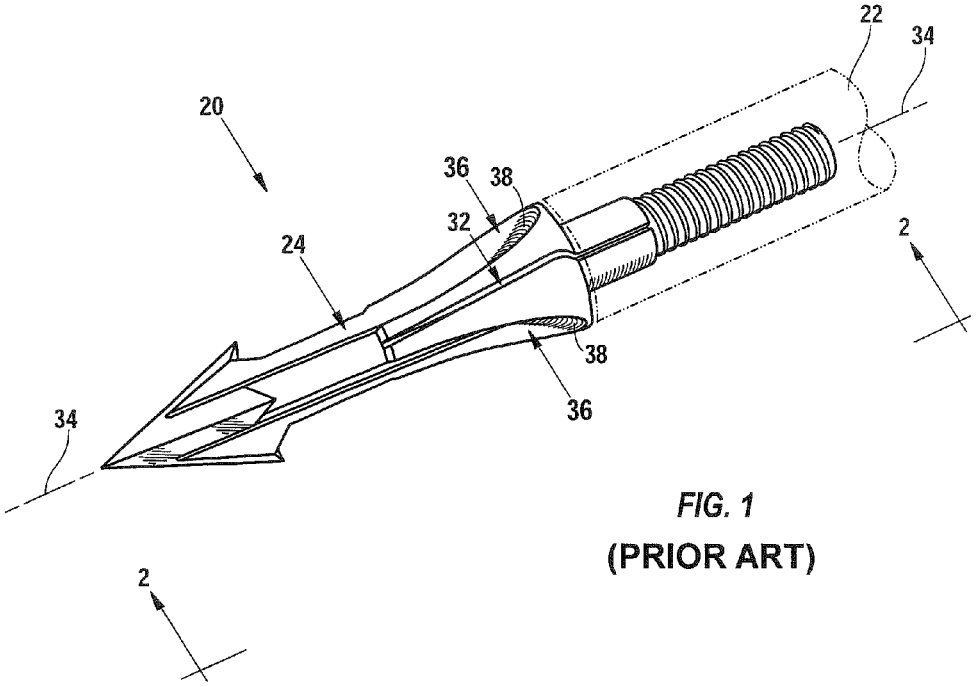
FIG. 1 (PRIOR ART)
FIG. 1 is an isometric view of the prior art arrowhead attached to a shaft.
Figure 2:
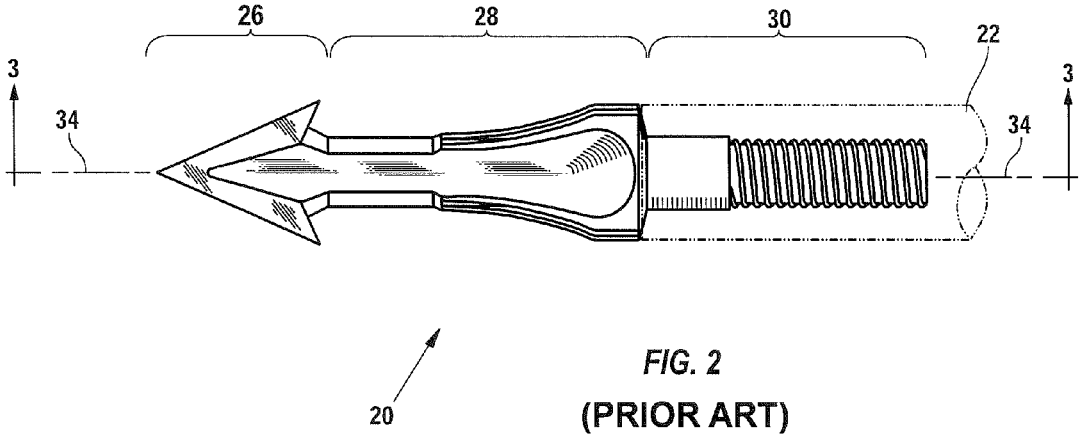
FIG. 2 (PRIOR ART)
FIG. 2 is a side elevation of the arrowhead shown in FIG. 1.
Figure 3:
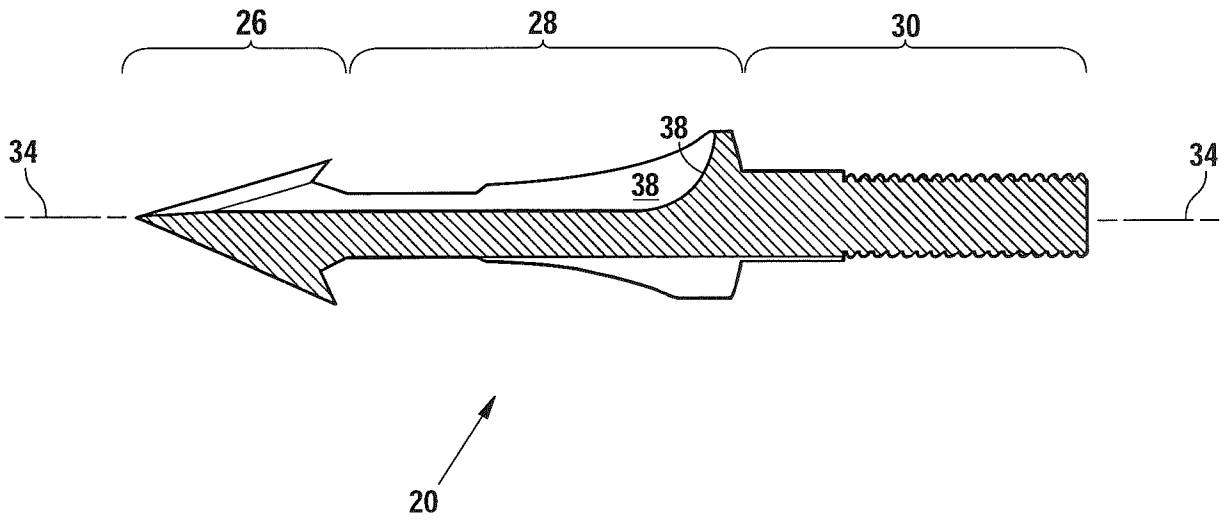
FIG. 3 (PRIOR ART)
FIG. 3 is a sectional view through line 3-3 of FIG. 2.

U.S. Pat. No. 8,142,310 (the '310 patent), which is incorporated by reference, shows an arrow with a shaft 13 having two ends. Referring to FIG. 1 of the '310 patent, one end has a nock 15, or notch, for receiving a bow string. Close to the nock 15 are feathers, vanes or fletching 17. The other end of the arrow has a female threaded fitting for receiving an arrowhead assembly 19 that includes three blades attached to and space equidistantly (e.g., one-hundred twenty degrees apart) around a ferrule 21. The ferrule 21 is threaded to the shaft 13.

Figure 4:
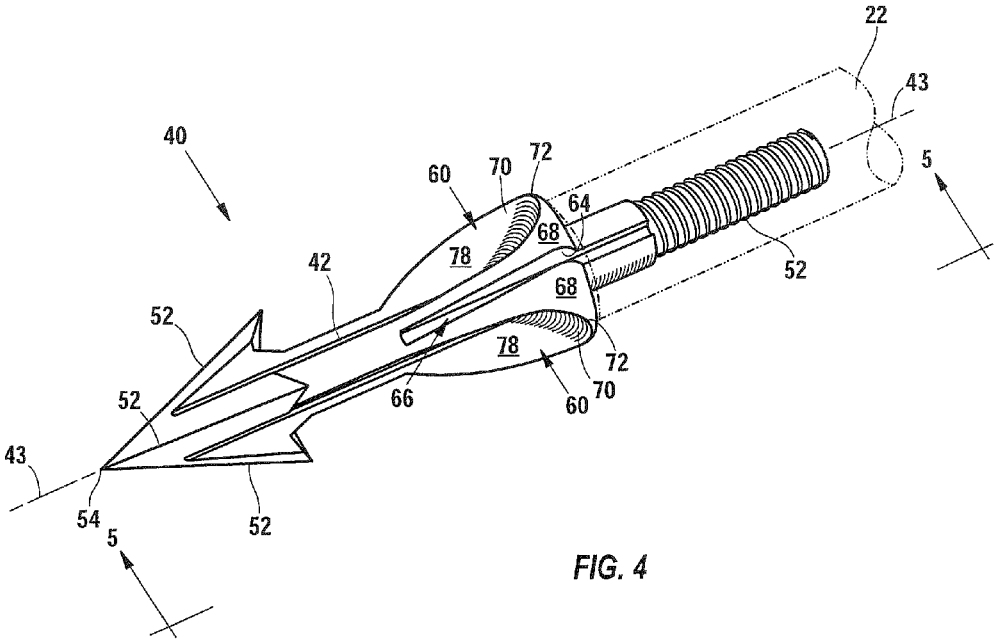
FIG. 4 is an isometric view of an embodiment of the present invention.
Figure 5:
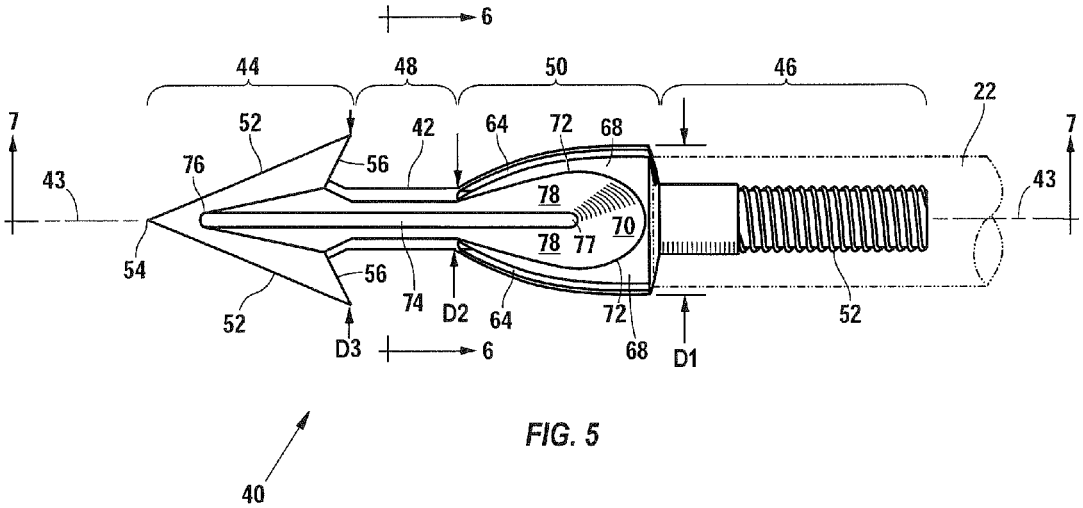
FIG. 5 is a side elevation of the embodiment shown in FIG. 4.

FIGS. 4-5 shows an arrowhead 40 with the features of the present invention that may be used with a standard arrow shaft, such as the shaft shown in the '310 patent. The arrowhead 40 has a ferrule 42 with a front end portion 44, a rear end portion 46, a first intermediate portion 48 longitudinally between the front end portion 44 and the rear end portion 46, and a second intermediate portion 50 longitudinally between the first intermediate portion 48 and the rear end portion 46. The first intermediate portion 48 has the same profile through any plane to which the axis 43 is normal. The rear end portion 46 has a threaded shaft 52 that threads into the female threaded fitting of an arrow shaft 22. The ferrule 42 is oriented along a longitudinal axis 43.

The front end portion 44 has three sharp edges 52 merging at a point 54. Each sharp edge 52 extends from the point 54 rearwardly a short distance to a nook edge 56. Each nook edge 56 extends radially out from the ferrule 42 and towards the first intermediate portion 48. The maximum diameter of the tip portion is D3. The intersection of a nook edge 56 and respective sharp edge 52 appears as a barb when viewed from the side. The nook edge 56 is blunt. The nook edge 56 and the first intermediate portion 48 form a nook for receiving a front portion of a blade, such as the interchangeable blades shown and described in the '310 patent.

The second intermediate portion 50 has three sections 60 spaced circumferentially apart to define a plurality of grooves 66 longitudinally aligned with the edges 52. One groove 66 circumferentially separates each pair of adjacent sections 60. Each section 60 comprises a pair of planar surfaces 64 circumferentially spaced apart and extending radially outward from the ferrule 42, a longitudinally-convex surface 68 adjacent to the planar surfaces 64, a concave surface 70, and the convex surface 68. In this embodiment, the concave surface 70 is a partially-conical surface. The concave surface 70 and convex surface 68 merge at a curved junction 72. The second intermediate portion 50 has a maximum outer diameter D1 longitudinally adjacent to an end of the shaft 22 and a minimum diameter D2 adjacent to the first intermediate section 48. The maximum distance from the longitudinal axis 43 to the junction 72 is larger than the shaft radius. D1 is less than diameter of the tip portion D3.

Figure 6:
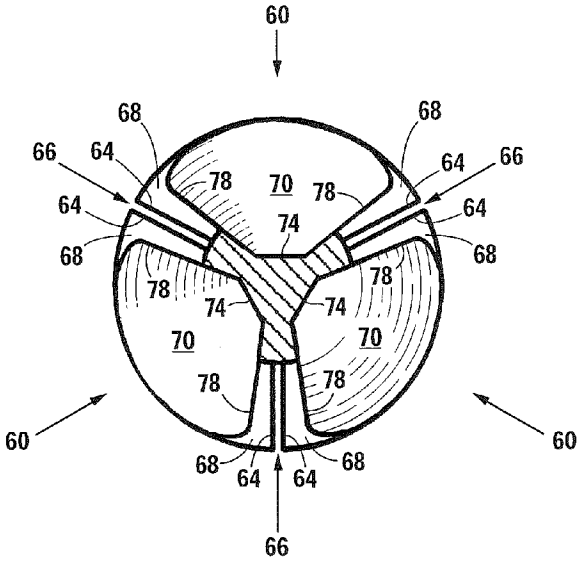
FIG. 6 is a sectional view through line 5-5 of FIG. 6.

Referring to FIG. 5-6, three elongate planar surfaces 74 extend longitudinally between the tip portion 44 and the second intermediate portion 50. The planar surfaces 74 are spaced equidistantly (e.g., every 120-degrees) around the ferrule 42. Each elongate surface 74 has a tip end 76 and a rear end 77. The rear end 77 is positioned longitudinally in the second intermediate portion 50 and is joined to opposing planar surfaces 78, which are adjacent to the concave surface 70 and radially-aligned with the longitudinal axis 43.

Figure 7:
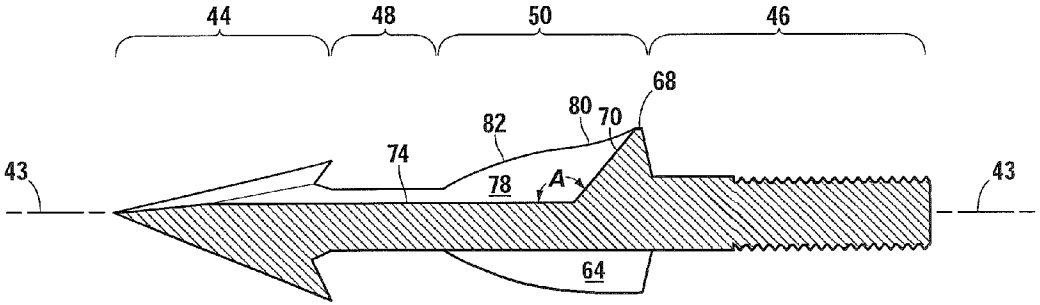
FIG. 7 is a sectional view through line 6-6 of FIG. 7.

Referring to FIG. 7, the angle A between the planar surfaces 74 and the corresponding curved surfaces 70 is one hundred thirty-five degrees. Alternative embodiments contemplate an angle between one-hundred fifty degrees and one-hundred twenty degrees. A rear section 80 of the junction 72 is concave, whereas a front portion 82 of the junction 72 is convex.

As the arrow 40 moves toward the game, the enlarged sections 60 are presented to the direction of flight. During flight, air moves relative to the arrowhead from the tip portion 44 toward the shaft portion 46 (i.e., rearward). A portion of the air moves between the edges and along the planar surfaces until it contacts the curved surfaces 70, where it is compressed and caused to move angularly outwardly and exert a radially-inward force on the intermediate section 50. Another portion of the air contacts the convex surfaces 68. The movement of the air relative to the arrowhead 40 in this manner results in improved stability relative to other arrowheads.

Upon impacting the game, the size of the intermediate section relative to the shaft 22 causes increased damage. The planar surfaces 74 facilitate bleeding of the game, which allows the game to be more easily tracked. As tissue contacts the second intermediate portion 50 when the arrowhead 40 is moving through the target, the surfaces 68, 70

The present invention is described in terms of a specifically-described embodiment. Those skilled in the art will recognize that alternative embodiments of such device can be used in carrying out the present invention. Other aspects and advantages of the present invention may be obtained from a study of this disclosure and the drawings, along with the appended claims.

The invention claimed is:

1. An arrowhead comprising:

a tip end, a shaft end, and a longitudinal axis intersecting the tip end and the shaft end;

a front end portion coterminal with the tip end, said front end portion comprising a plurality of blades, each blade having a front edge, a nook edge, an outer corner at the merger of the front edge and the nook edge, the front end portion having a first maximum diameter;

a rear end portion coterminal with the shaft end;

a front intermediate portion longitudinally positioned between said front end portion and said rear end portion, said front intermediate portion having a uniform profile through any plane transverse to the longitudinal axis;

a rear intermediate portion longitudinally positioned between said front intermediate portion and said rear end portion and having a second maximum diameter, said rear intermediate portion having a plurality of sections spaced circumferentially apart to define a plurality of grooves aligned with said plurality of blades, each section comprising:

a first planar surface;

a second planar surface not parallel to said first planar surface;

a concave surface adjacent to said first planar surface, said second planar surface, said rear end portion, and said front intermediate portion; and a longitudinally-convex surface adjacent to said concave surface.

2. The arrowhead of claim 1 further comprising a plurality of planar elongate surfaces extending parallel to said longitudinal axis between said front end portion and said rear intermediate portion, each elongate surface spaced circumferentially equidistant from two of said blades and adjacent to one of said concave surfaces.

3. The arrowhead of claim 2 wherein the angle between the longitudinal axis and the corresponding curved surfaces in a plane intersecting the longitudinal axis and bisecting the corresponding section is between one-hundred fifty degrees and one-hundred twenty degrees.

4. The arrowhead of claim 1 wherein the second maximum diameter of the rear intermediate portion is less than the first maximum diameter.

5. An arrowhead comprising:

a tip end, a shaft end, and a longitudinal axis intersecting the tip end and the shaft end;

a first portion longitudinally positioned between said tip end and said shaft end and having a first maximum diameter;

a second portion coterminal with the tip end;

a third portion coterminal with the shaft end;

wherein said first portion has a plurality of sections spaced circumferentially apart to define a plurality of longitudinal grooves, each section comprising:

a first planar surface;

a second planar surface not parallel to said first planar surface;

a concave surface adjacent to said first planar surface, said second planar surface, said third portion, and said second portion; and a longitudinally-convex surface adjacent to said concave surface.

6. The arrowhead of claim 5 wherein said second portion comprises a plurality of blades aligned with the plurality of longitudinal grooves, each blade having a front edge, a nook edge, an outer corner at the merger of the front edge and the nook edge, said second portion having a second maximum diameter.

7. The arrowhead of claim 6 further comprising a fourth portion longitudinally positioned between said second portion and said third portion, said fourth portion having a uniform profile through any plane transverse to the longitudinal axis.

8. The arrowhead of claim 7 further comprising a plurality of planar elongate surfaces extending parallel to said longitudinal axis between said first portion and said second portion, each elongate surface spaced circumferentially equidistant from two of said blades and adjacent to one of said concave surfaces.

9. The arrowhead of claim 8 wherein the angle between the longitudinal axis and the corresponding curved surfaces in a plane intersecting the longitudinal axis and bisecting the corresponding section is between one-hundred fifty degrees and one-hundred twenty degrees.

10. The arrowhead of claim 6 wherein the first maximum diameter of the first portion is less than the second maximum diameter.

* * * * *